US005884545A

United States Patent [19]

Hamby, Jr.

[11] Patent Number: 5,884,545

[45] Date of Patent: Mar. 23, 1999

[54] LOG SAWING ASSEMBLY

[76] Inventor: Thomas E. Hamby, Jr., 1776 Arbor Grove Church Rd., Purlear, N.C. 28665

[21] Appl. No.: 951,282

[22] Filed: Oct. 16, 1997

Related U.S. Application Data

[63] Continuation of Ser. No. 597,927, Feb. 7, 1996, abandoned.

[51] Int. Cl.[6] ..... B26D 7/06; B26D 1/36; B27B 17/00

[52] U.S. Cl. ..... 83/165; 83/167; 83/155; 83/229; 83/595; 83/596; 83/795; 83/796; 83/486.6; 83/646; 83/928; 144/379; 144/245.2; 144/250.17; 144/250.13

[58] Field of Search ..... 144/379, 357, 144/378, 245.2, 250.17, 250.13; 83/795, 796, 468.6, 646, 596, 607–612, 928, 591, 229, 225, 226, 63, 76.1, 76.4, 76.8, 76.9, 165, 167, 155, 468.5, 592, 594, 595

[56] References Cited

U.S. PATENT DOCUMENTS

| | | | |
|---|---|---|---|
| 719,585 | 2/1903 | Hanssler | 83/928 X |
| 2,756,784 | 7/1956 | Cherem . | |
| 2,775,570 | 7/1956 | Blackburn et al. . | |
| 2,917,090 | 12/1959 | Streed | 144/208.1 |
| 2,960,123 | 11/1960 | O'quinn | 83/928 X |
| 3,049,954 | 8/1962 | Barlament et al. | 83/796 X |
| 3,114,282 | 12/1963 | Reifenhauser et al. | 83/596 X |
| 3,554,249 | 1/1971 | Arnelo | 144/357 X |
| 3,677,312 | 7/1972 | Tanguay | 83/468.6 X |
| 3,771,395 | 11/1973 | Heimerl | 83/795 X |
| 3,783,725 | 1/1974 | Payeur | 83/326 |
| 3,913,642 | 10/1975 | Porter | 144/114.1 |
| 4,009,741 | 3/1977 | Zimmerman | 144/41 |
| 4,082,129 | 4/1978 | Morelock | 144/368 |
| 4,181,056 | 1/1980 | Zimmerman | 83/360 |
| 4,204,798 | 5/1980 | Warren et al. | 144/357 X |
| 4,210,184 | 7/1980 | McGriff | 144/364 |
| 4,240,477 | 12/1980 | Horn et al. | 144/245.1 |
| 4,245,535 | 1/1981 | Lockwood et al. . | |
| 4,269,242 | 5/1981 | Smith et al. | 83/928 X |
| 4,294,295 | 10/1981 | Olin | 83/468.6 X |
| 4,298,042 | 11/1981 | Peltola . | |
| 4,530,266 | 7/1985 | Hedberg . | |
| 4,553,463 | 11/1985 | Engel . | |
| 4,721,139 | 1/1988 | Peterson et al. | 144/248.7 |
| 4,722,258 | 2/1988 | Johnson . | |
| 4,875,511 | 10/1989 | Wingate-Hill et al. | 144/208.1 |
| 4,997,017 | 3/1991 | Dobbie | 144/128 |

*Primary Examiner*—Rinaldi I. Rada
*Assistant Examiner*—Boyer Ashley
*Attorney, Agent, or Firm*—Bell Seltzer Intellectual Property Law Group of Alston & Bird LLP

[57] ABSTRACT

There is provided a device for sawing logs to a predetermined length which includes a log lead-in support member, a log support frame, a log cutting station and a log collection deck. The log support frame includes a front end, a rear end, opposite sides and supports a conveyor. An upwardly inclined conveyor moves a log lengthwise through the support frame to the log cutting station which includes a stop gate section, a sawing section, and a debris discharge conveyor. The stop gate section is positioned between the conveyor and the sawing section to set the log for proper timing into the cutting station and to align the butts when a plurality of logs is cut at the same time. A cutting station positioned at the front end of said support frame comprising a housing and a chain saw having a cutting bar on said support frame pivotally mounted to rotate 360°, whereby when one log is cut to its predetermined length the conveyor automatically moves a further section of the uncut log to a cutting position as the cutting bar makes its rotation.

17 Claims, 6 Drawing Sheets

LOG SAWING ASSEMBLY

This application is a continuation of application Ser. No. 08/597,927, filed Feb. 7, 1996 now abandoned.

BACKGROUND OF THE INVENTION

1. Field of the Invention

The present invention relates generally to an assembly for sawing logs to a predetermined length. More particularly, this invention relates to a log sawing assembly for automatically moving a log to a cutting station and a cutting station using a chain saw that pivots from one end and rotates in a full circle to cut the succeeding section of a log to a predetermined length.

2. The Prior Art

Many logging operations require that logs be cut to predetermined lengths such as 8 to 16 or so feet. This cutting step occurs either in the woods or at a collection station and follows the delimbing operation. Typically, knuckleboom loaders gather and place delimbed logs or tree boles in a suitable rack to be cut by radial or chain saws mounted to the rack. Equipment that has been designed for that purpose requires that the cutting cycle be stopped once a section of the log has been cut in order for the cutting blade to be returned to its upright or non-cutting position and a new section of log be moved to the cutting area, often using a knuckleboom loader. When using such equipment, considerable down time occurs while the cutting blade is being returned to its non-cutting position and the while the logs are being moved to the cutting area.

An example of such equipment is shown in U.S. Pat. No. 4,722,258 to Johnson where there is disclosed a log sawing apparatus in which a hydraulically actuated chain saw is moved in an upward and downward arrangement to cut logs. Once a cut has been made through a stack of logs, a knuckleboom loader grabs the remaining stack of uncut logs and manually places them in a new cutting position. Such placement, because it is not very accurate in the lengthwise position, results in cutting to lengths longer than necessary, causing waste.

U.S. Pat. No. 4,553,463 to Engel discloses a portable wood cutting device in which a handle is attached to the chain saw blade at the free end thereof for manual movement of the cutting blade. The cutting blade is actuated by an elastic strip member engaged with a throttle so as to activate the blade on the downward movement of the saw blade from its elevated non-cutting position to its lowered cutting position. Engel also provides a log support table on which logs to be sawed are manually moved to the cutting area on horizontally canted rollers.

U.S. Pat. No. 4,530,266 to Hedberg discloses equipment for cutting logs in which the cutting bar is pivotally mounted on a holder to move out of the way once a cutting cycle has been complete and the cutting bar is returned to its precutting downward stroke as a fresh section of the log passes to the cutting area.

Therefore, a need exists for a log sawing assembly that automatically moves logs to a cutting station and cuts the logs accurately to a predetermined length with a minimum of down time.

SUMMARY OF THE INVENTION

With the foregoing in mind, it is therefore an object of the present invention to provide a log sawing assembly which provides for automatic, continuous cutting of a log to a predetermined length.

Another object of the present invention is to provide an improved log sawing assembly which automatically moves a log to a cutting station and uses a chain saw that pivots from its drive end to rotate in a full circle to cut the succeeding section of log.

Still another object of the present invention is to provide an assembly for sawing logs which is durable, relatively maintenance free, and portable.

In accordance with the present invention, these and other objects, features and advantages are achieved by the embodiments illustrated herein by the provision of a log sawing device for sawing logs to a predetermined length. There is provided a log lead-in support member, a log support frame, a log cutting station and a log collection deck.

In one embodiment of the sawing assembly, a log lead-in support member is positioned at the rear end of a log support frame to support the lengthy tree bole as it passes through a conveyor on its way to being cut to the desired length. The log lead-in support member may be mounted to the rear end of the log support frame about hinges whereby the member may be rotated upwardly to rest on top of the log support frame.

The log support frame includes a front end, a rear end and opposite sides and supports a conveyor and power unit. The conveyor moves a log lengthwise from the rear end to the front end of the support frame to the log cutting station. The surface of the conveyor belt preferably lies slightly below slanting walls which form a trough in which the logs are maintained as they move to the cutting station. The conveyor is preferably upwardly inclined from the rear end to the front end of the support frame. The chain belt conveyor preferably includes projections or teeth on its outer surface for grasping the bark of the log to aid in moving the tree to the cutting station.

In a preferred embodiment, hydraulic log rams are provided to push the small logs across the upper surface of the conveyor and up the inclined slope of the trough-forming side wall of the conveyor and over the side of the frame. There is also provided a feed roller positioned above a log as the log moves on the conveyor. The feed roll is spring biased against the log to aid in centering the log on the chain conveyor as it passes into the log cutting station to ensure a proper cut.

The conveyor moves the logs to the log cutting station which includes a stop gate section and a sawing section. The stop gate section is positioned between the conveyor and the sawing section to set the log for proper timing of the distance and activation of the cutting saw and to align the butts when a plurality of logs are cut at the same time. The cutting station is positioned at the front end of the support frame comprising a housing and a chain saw having a cutting bar on the support frame pivotally mounted to rotate 360°, whereby when one log is cut to its predetermined length the conveyor automatically moves a further section of the uncut log to a cutting position as the cutting bar makes its rotation.

In another embodiment, a debris discharge conveyor is positioned between and below the conveyor belt and the stop gate to catch the dirt, bark or other debris that is dislodged from the log as it passes up the conveyor trough. In yet another embodiment, there is provided a log collector which includes a frame having a log collection deck which catches the log after it is cut and allows the log to pass over its edge and down an incline to an expandable collection rack that is wide enough to accommodate the grapple of the knuckleboom loader.

BRIEF DESCRIPTION OF THE DRAWINGS

Other objects, features and advantages of the present invention will be apparent from the detailed description of the invention when taken in conjunction with the accompanying drawings, in which.

DESCRIPTION OF THE PREFERRED EMBODIMENTS

Figure 1:
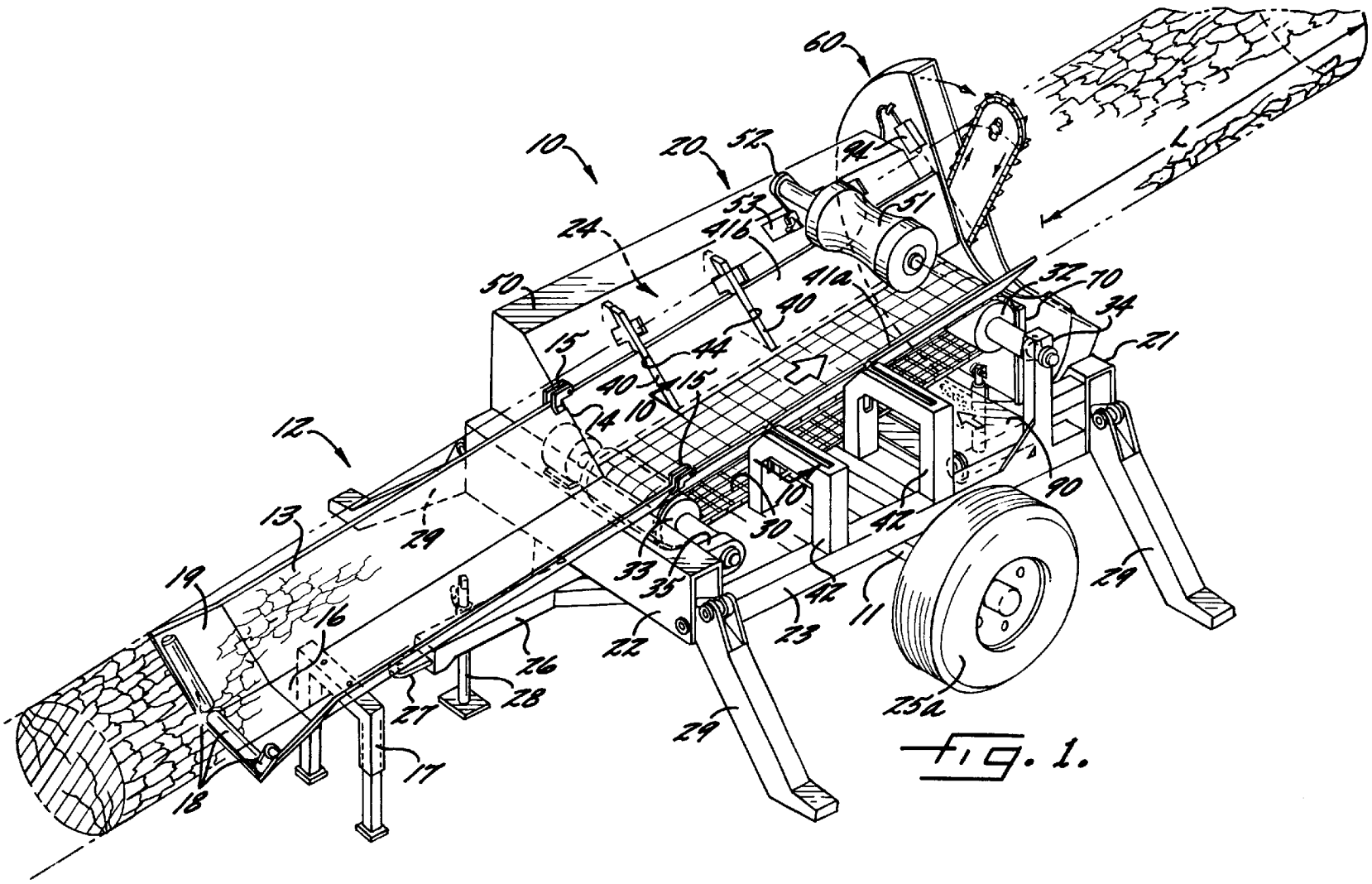
FIG. 1 is a perspective view of the lead-in and log support frame of the log sawing assembly of the present invention.

Referring now to FIG. 1, there is provided a log sawing assembly, referred to generally by reference 10, for continuously sawing logs to predetermined lengths L, e.g., from about 8 to 16 feet or longer. The log sawing assembly 10 is placed near a stack of delimbed logs and within reach of a knuckleboom loader which is used to lift the logs onto the log sawing assembly. These logs are typically 30–60 feet or more in length and are cut to predetermined lengths at the harvesting site. While it is desirable to perform the cutting on-site, it should be understood that the log sawing assembly 10 can be permanently placed in a mill. The log sawing assembly 10 includes a log lead-in support member 12, a log support frame 20, a log cutting station 60, and a log collector deck 100.

As shown in FIG. 1, the log lead-in support member 12 is a trough 13 located at the rear or entrance of the log support frame 20. The trough 13 may be generally U-shaped having a bottom 16 to support the lengthy tree bole as it passes through the log support frame 20 on its way to being cut to the desired length. The forward end 14 of the trough 13 may be attached to the log support frame 20 by any suitable means, such as by hinges 15 located at either side of the upper forward end of the trough 13. The rear end 19 of the trough 13 is supported on the ground by an adjustable support member, shown as bracket 17, attached to the underside of the trough 13. The rear end of trough 13 is preferably flared at the bottom 16 and sides and may include rollers 18 to aid in moving the log through the trough 13. The lead-in member 12 may be rotated upwardly about hinges 15 to rest on top of log support frame 20 during movement of the assembly 10 to different cutting sites.

A log support frame 20, generally rectangular, is provided having a front end 21, a rear end 22, a log exit side 23, and an opposing side 24. Preferably, the support frame is constructed of steel. The log support frame 20 is supported above the ground on a pair of wheels 25*a*, 25*b* best seen in FIG. 3, rotatably mounted on axle 11, which is mounted to the underside of the support frame 20 between the front end 21 and the rear end 22. The wheels 25*a*, 25*b* are preferably located slightly forward of the center between the ends of the support frame for proper balance. Extending rearwardly from the rear end 22 is a tongue 26 having a hitch 27 attached to its end for connecting to a truck for transportation of the assembly 10 from one location to another. An adjustable support member 28, which is designed to rest on the ground when the assembly 10 is not being transported from one location to another, is attached to tongue 26. Hydraulic stabilizers 29 are provided at each corner of the frame 20. Suitable cylinders and piston are provided for moving the stabilizers. A conventional power unit (not shown), preferably driven by an internal combustion engine, is also carried on the support frame 20 under cover 50.

Figure 2:
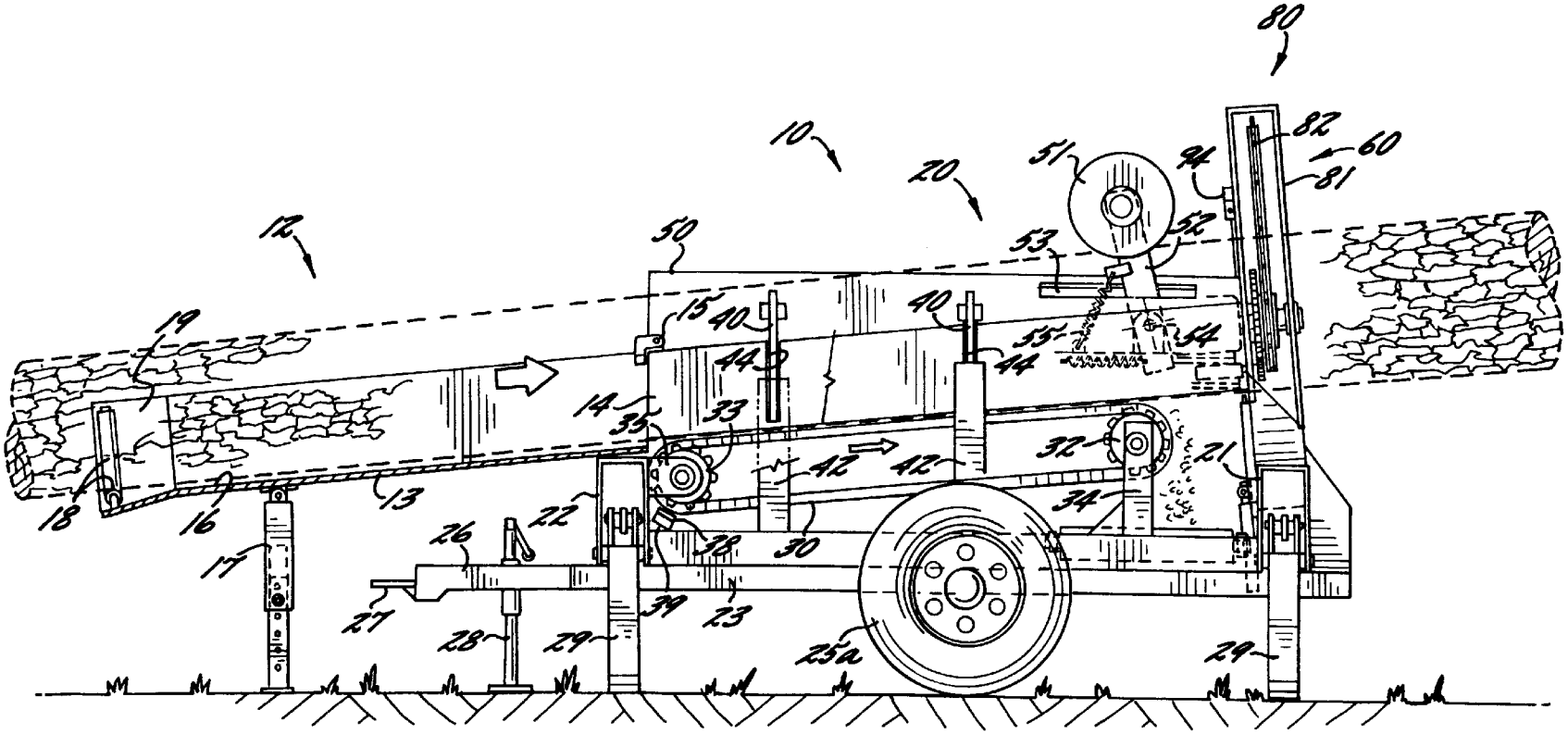
FIG. 2 is a side elevation view of the log sawing assembly of the present invention.

The logs are conveyed through the log support frame 20 along a bed or conveyor, shown in FIG. 2 as chain belt conveyor 30, to the log cutting station 60. The conveyor 30 is located between frame sides 23, 24 and extends from the front end 21 to the rear end 22 of frame 20. The front end of the conveyer is supported by drive roll 32 and the rear end of the conveyor belt is supported by roll 33. The drive roll 32 is powered from the power unit located under cover 50. In operation, the assembly operator activates the conveyor by starting the drive roll 32 to automatically move the logs through the conveyor trough. The rolls 32, 33 are mounted to the log support frame 20 by journeled support members 34, 35, respectively, located at each end of the rolls. The surface of the conveyor belt lies slightly below slanting walls 41*a*, 41*b* which form a trough in which the logs are maintained as they are passed to the cutting station 60. The conveyor is preferably slightly upwardly inclined from the rear end 22 to the front end 22 of the support frame 20.

Figure 9:
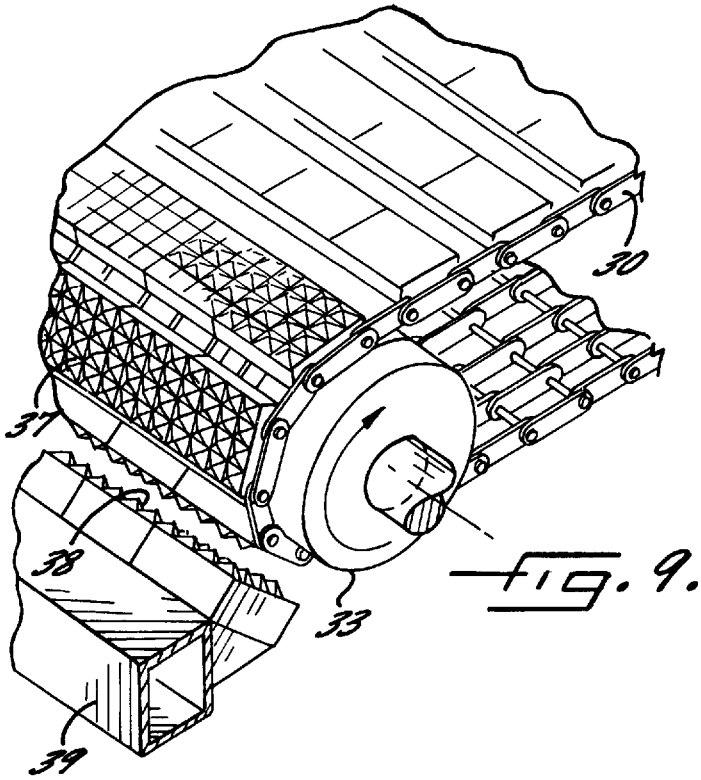
FIG. 9 is a partial perspective view of the log conveying chain of FIG. 1.

As shown in FIG. 9, the chain belt conveyor 30 includes projections or teeth 37 on its outer surface for grasping the bark of the tree bole to aid in moving the tree to the cutting station 60. As often happens, bark catches in the areas between the projections 37 and must be removed. For this purpose, bark teeth cleaner 38 is provided. The bark teeth cleaner 38 is formed of teeth which pass between the rows of conveyor teeth 37 as the conveyor rotates to strip any debris from the teeth. The teeth cleaner 38 is attached to mounting bar 39 which is in turn attached to the rear end of frame 20.

Figure 10:
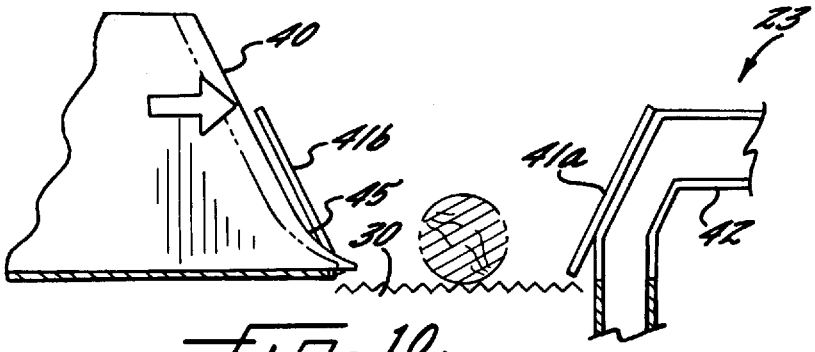
FIG. 10 is a view taken along lines 10—10 of FIG. 1 illustrating the log ram in open position.
Figure 11:
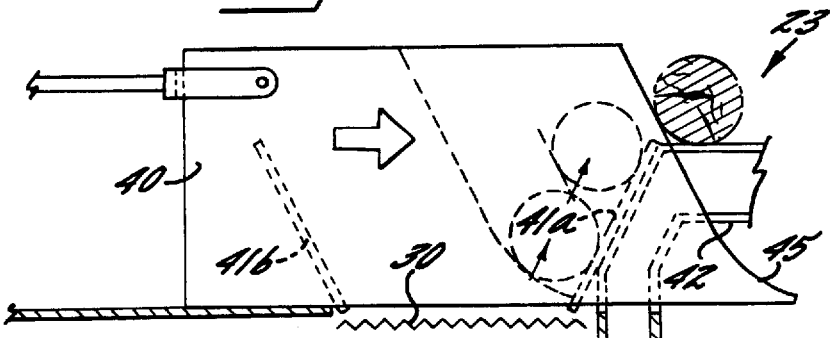
FIG. 11 is a view taken along lines 10—10 of FIG. 1 showing the log ram in closed position.

When the log gets to its small end after the cutting of several lengths, e.g., 3 inches or so in diameter, it is normally not passed through the log cutting station 60 but is instead moved to the side of the log support frame 20. This is accomplished by activating hydraulic log rams 40 which push the log across the upper surface of conveyor 30 and up the inclined slope of side wall 41*a* of side brackets 42 attached to log exit side 23 and over the side of the frame 20 as shown in FIGS. 10 and 11. These small diameter sections of the log are periodically gathered by the knuckleboom loader and removed from the cutting site. When the log rams 40 are at rest, e.g., not removing a small diameter log, they are housed within the mechanical cover 50. When activated, the log rams 40 pass through slots 44 in the mechanical cover 50. The forward end of the lower edge 45 of the log rams 40 is preferably angled to a point whereby the point at the lower edge can easily slide underneath the log to facilitate removal over brackets 42.

There is also provided a feed roller 51 connected by arm 52 pivotally mounted at 54 to support frame 20. The arm 52 projects through a slot 53 in mechanical cover 50. The feed roll 51 is positioned above the log as it passes on the conveyor 30 through the support frame 20. The feed roll 51 is spring biased 55 against the log to maintain the log in place as it passes into the log cutting station 60 to ensure a proper cut. The feed roll 51 has a sufficient arc, as may be seen in FIG. 3, to aid in centering the log.

The log cutting section 60 includes a stop gate section 70, a sawing section 80, and may include a debris discharge conveyor 90.

Figure 6:
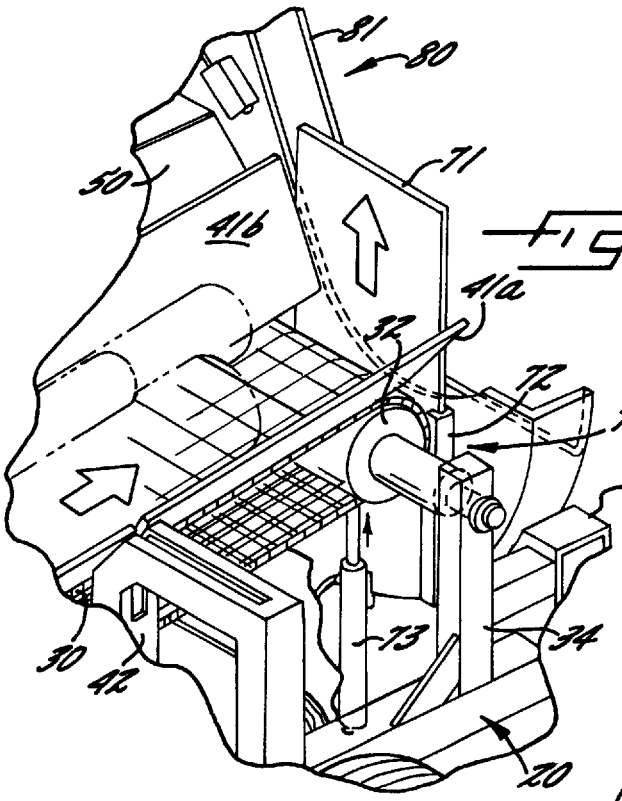
FIG. 6 is a partial perspective view of the log stop gate in upright position.
Figure 7:
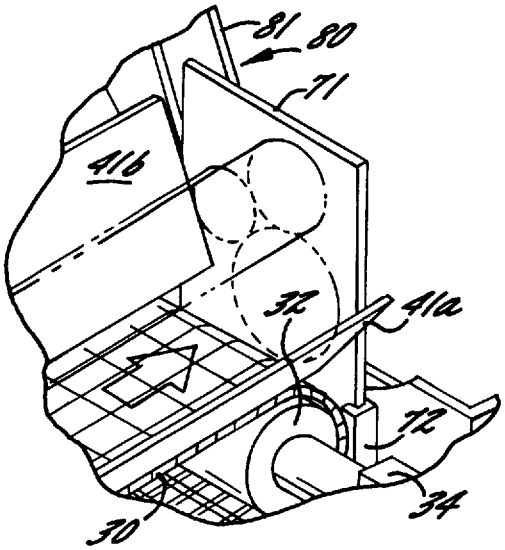
FIG. 7 is a partial perspective view of the log stop gate illustrating a group of logs in abutting position.
Figure 8:
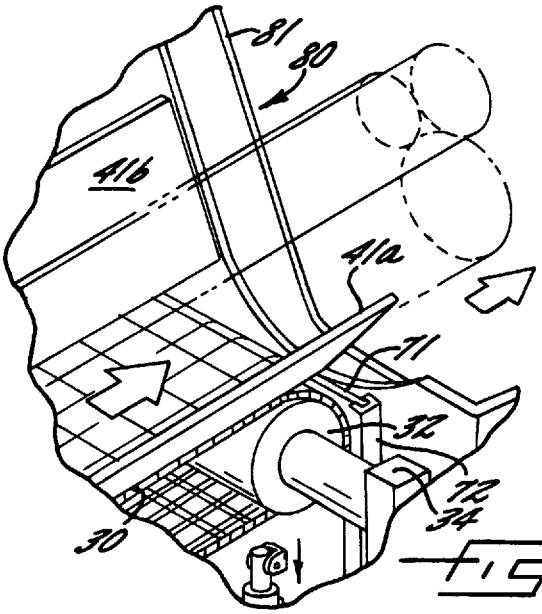
FIG. 8 is a partial perspective view of the log stop gate in its open position.

A stop gate section 70 is positioned between the conveyor 30 and the sawing section 80 to set the log for proper timing into the cutting station and to align the butts when a plurality of logs is cut at the same time before the logs enter the sawing section 80. FIGS. 6 through 8 show a partial perspective view of the stop gate section 70. As shown in FIG. 6, the stop plate 71 is held in place by gate holder 72 and is shown in its raised or closed position. The stop plate is raised and lowered by hydraulic piston 73. As the logs are moved toward the front end 21 by conveyor 30 they strike stop plate 71, as shown in FIG. 7, and the log butts are aligned so that each log will be sawed to the same length. The operator then lowers stop plate 71 through gate holder 72 and the aligned logs pass to the sawing section 80 as shown in FIG. 8.

Figure 3:
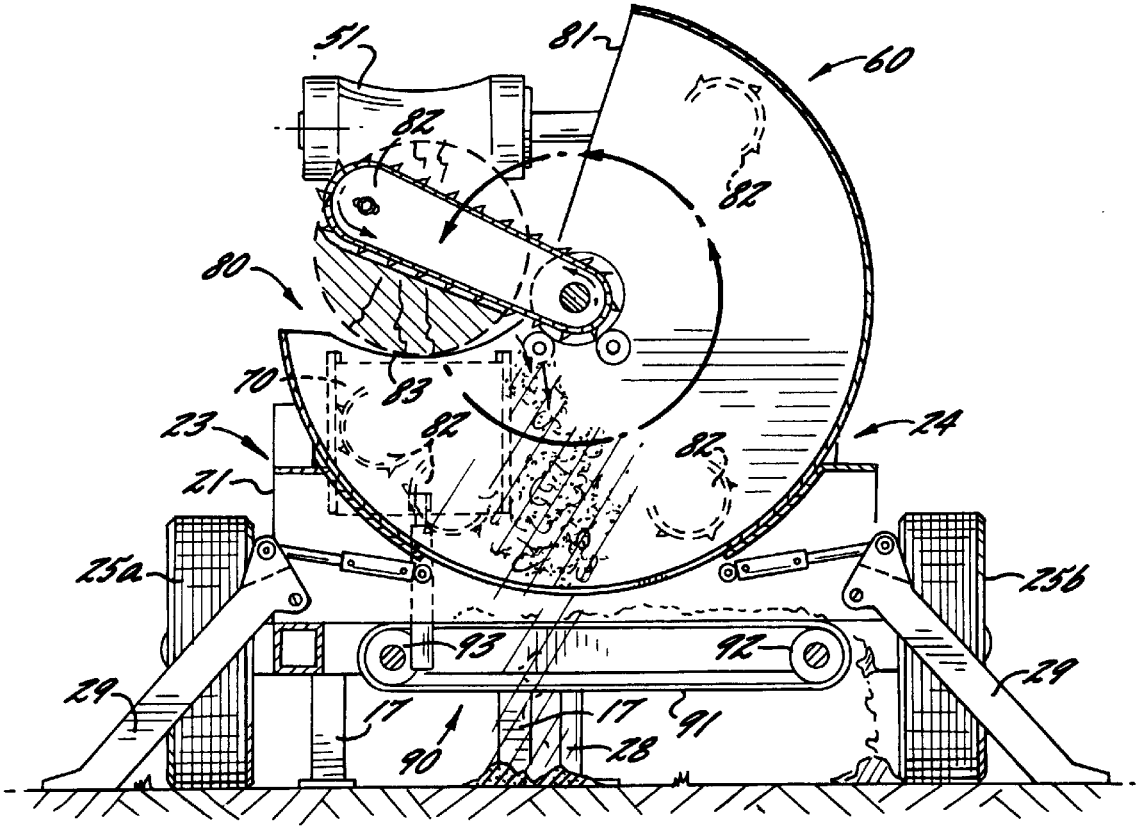
FIG. 3 is a front elevation view of the log cutting station of the present invention.
Figure 4:
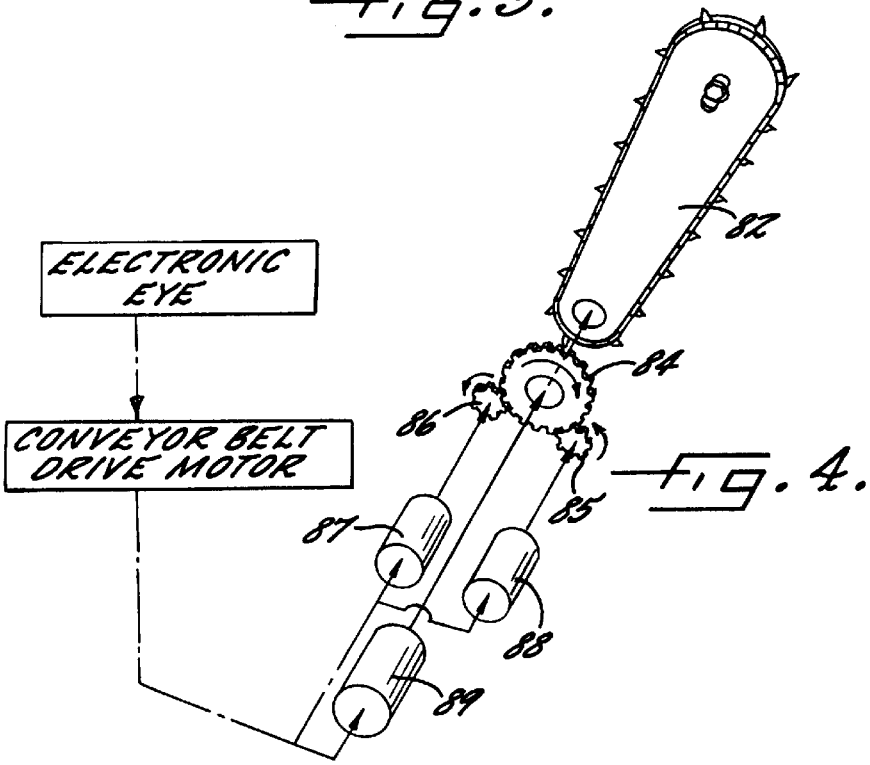
FIG. 4 is a schematic diagram of the saw cutting mechanism of the present invention.

The logs are often covered with debris such as dirt and loose bark. As the logs pass the front end of the conveyor much of the debris falls toward the ground. In a preferred embodiment, a debris discharge conveyor 90, positioned between and below the conveyor belt 30 and the stop gate 70, is provided to catch the dirt, bark or other debris that is dislodged from the log as it passes through the conveyor trough. As shown in FIG. 3, the discharge conveyor 90 includes conveyor belt 91 around rollers 92, 93, which discharges the debris to the side of the assembly for easy pick-up. Activation and operation of the discharge conveyor is timed with the movement of the conveyor and is accomplished in a conventional manner by connection to the power unit.

FIG. 3 is a front view of the log sawing section 80 which is positioned at the front end of support frame 20. The log sawing section 80 includes a housing 81 and a chain saw 82. The housing 81 surrounds the arc of the chain saw 82 and is mounted to the front end 21 of support frame 20. The housing 81 is open in its bottom portion to allow the sawdust to fall out the bottom onto the ground. However, it should be understood that the majority of the sawdust is removed away from the cutting chain by action of the saw teeth. The housing 81 has a portion of its upper half open to form a tree engaging slot 83 so that the tree may pass through. The lower edge of the slot 83 is preferably slightly arced to more easily accommodate a log.

The chain saw 82 has a cutting bar pivotally mounted to the center of the house 81 at its drive end to rotate in a 360° circle, as indicated by the arrows. The cutting blade rotates in a counter clock-wise direction, as indicated by the arrows.

The cutting bar is rotated by a series of gears 84, 85, and 86 connected to a pair of motors 87, 88. A third motor 89 is provided for driving the chain around the bar. The cutting bar must cut fast enough so that there are no splits in the log as the cut is completed. The sawing assembly also includes an automatic actuator, such as measuring eye 94.

As noted, cover 50 is provided, which houses the power unit including the hydraulic pumps and cylinder, motors, controls and the like required to operate the assembly 10. Operation of the various hydraulic cylinders and motors is accomplished in a known manner by conventional controls.

Figure 5:
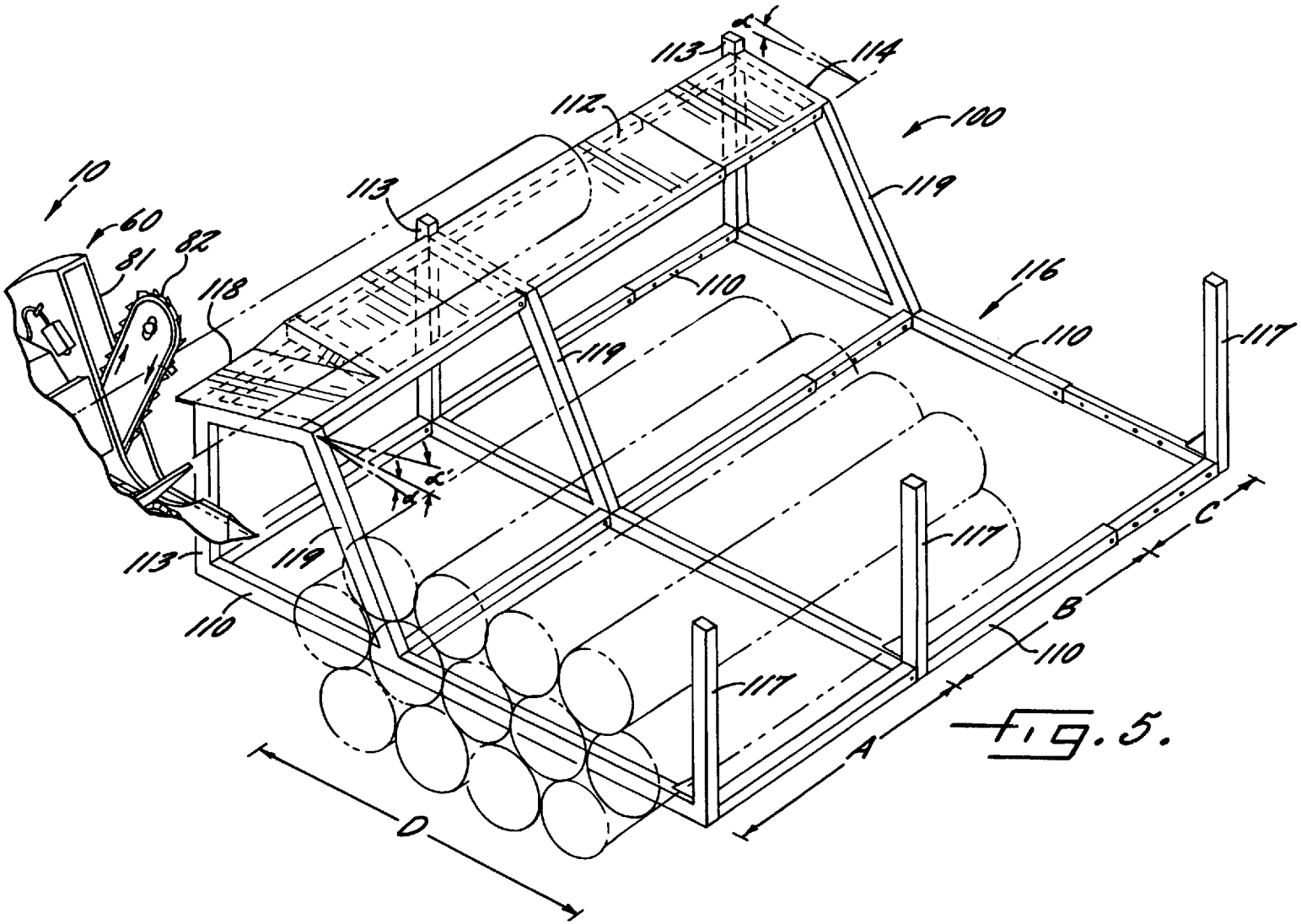
FIG. 5 is a perspective view of the log cutting deck of the present invention.

Once the log has been cut to its predetermined length, several logs are collected into a pile for easy removal to a truck via the knuckleboom loader. FIG. 5 is a perspective view of the log collector 100. The log collector 100 includes a frame 110 having a log catcher deck 112 which catches the log after it is cut and allows the log to pass over its edge and down an incline 114 to an expandable collection rack 116 that is wide enough to accommodate the grapple of the knuckleboom loader. The log catcher deck 112 is supported by welded frame supports 113, 119 connecting the deck to the base of the frame. The upper end of the furtherest supports 113 may extend slightly above the deck to prevent logs from inadvertently rolling to the wrong side. The log collector 100 is preferably slightly lower than the bottom of the log as it is cut. The angle $\alpha$ of the incline 114 is small and need only be slightly downward toward the log collection rack 116 so that the log will roll down the incline 114 and inclined supports 119 into the collection area. The log catcher deck 112 has an area 118 inclined to the opposite side of the log sawing assembly 10 for removing short pieces of log, e.g., it is designed to collect short logs of three feet or shorter which are present where a tree bole has, for example, a crook in the bole and the operator wishes to cut that bad section out of the log. This short log removal deck area 118 is located at the rearward part of the log catcher deck 112 adjacent the sawing area. The log collection rack 116 is defined by retention arms 117 on one side and inclined supports 119 on the other side. As noted, the frame 110 is expandable in length, note distances A, B, and C, and in width, note distance D.

In operation, the log sawing assembly is first moved to the site where the logging operation is being carried out. After reaching the site, the stabilizers are lowered. A knuckleboom loader places one or more logs onto the conveyor and lead-in support member. The operator, after programming the desired length or lengths, raises the stop gate and activates the conveyor to move the log or logs to the raised stop gate. When the log or logs reach the stop gate, the operator simply activates the system which lowers the stop gate and starts the conveyor which moves the logs the predetermined distance. As the predetermined distance is reached, the electric eye signal causes the conveyor to automatically stop and simultaneously activates the chain saw. The rotation of the chain saw is timed to begin the cut as soon as the predetermined length is reached. After the cut is complete, the chain saw continues to rotate through the 360° circle as the conveyer activates to move the logs to the next section to be cut.

There has been provided a log sawing assembly which automatically cuts logs to a predetermined length using a saw bar that operates in a continuous 360° circle.

The invention has been described in detail with particular reference to preferred embodiments and the operation thereof, but it is understood that variations, modifications, and the substitution of equivalent means can be effected within the spirit and scope of this invention.

What is claimed is:

1. An assembly for sawing logs to a predetermined length comprising:

a log support frame including a front end and a rear end and opposite sides;

a conveyor having an upper surface supported on said support frame for moving a log lengthwise from the rear end to the front end of said support frame to a cutting station, said conveyor being upwardly inclined from said rear end to said front end of said support frame; and said cutting station being positioned at the front end of said support frame and comprising a stop gate and a sawing section, said stop gate being located between said sawing section and said rear end of said support frame, said sawing section comprising a housing mounted to said support frame and a chain saw having a cutting bar pivotally mounted at a drive end of the cutting bar, and a rotator mechanism operable to rotate said bar through a 360° rotation about said drive end during and after completion of a log-sawing operation, such that after said chain saw is rotated through a portion of said 360° rotation to saw through said log, said rotator mechanism continues to rotate said cutting bar through the remainder of said 360° rotation simultaneously with said conveyor moving a remaining portion of said log into said cutting station for a subsequent sawing operation, said housing surrounding at least a portion of said cutting bar and said housing having an opening to accommodate said log.

2. The sawing assembly according to claim 1 further comprising a log lead-in support member positioned at the rear end of said log support frame to support said log as said conveyor moves said log to said cutting station to be cut to said predetermined length.

3. The sawing assembly according to claim 2 wherein said log lead-in support member is mounted to said rear end about hinges whereby said member is rotatable upwardly to rest on top of said log support frame.

4. The sawing assembly according to claim 1 wherein said conveyor further comprising discharge rams which when activated push said log across said upper surface of said conveyor and up side wall and over said log support frame.

5. The sawing assembly according to claim 1 wherein said support frame further comprising a feed roll positioned above said conveyor to engage a top surface of said log as said log passes on said conveyor, said feed roll being spring biased against said log for centering said log along said conveyor.

6. The sawing assembly according to claim 1 further comprising a debris discharge conveyor positioned between and below conveyor and said stop gate to catch dirt, bark and other debris that is dislodged from said log as said log moves along said conveyor.

7. The sawing assembly according to claim 1 further comprising a log collector which includes a frame having a deck which catches said log after it is cut to said predetermined length and allows said log to pass down a collection rack.

8. The sawing assembly according to claim 1 wherein said conveyor is a chain belt conveyor having projections on its outer surface.

9. The sawing assembly according to claim 1, wherein the rotator mechanism comprises a gear affixed to the cutting bar for rotation therewith, and at least one motor operably coupled with said gear to rotatably drive said gear so as to rotate the cutting bar 360° about the drive end thereof.

10. An assembly for sawing logs to a predetermined length comprising:

a log support frame including a front end and a rear end and opposite sides;

a log lead-in support member positioned at the rear end of said log support frame to support said log as said log passes through the log support frame to be cut to said predetermined length;

a conveyor having an upper surface supported on said support frame for moving said log lengthwise from the rear end to the front end of said support frame to a cutting station, said conveyor being upwardly inclined from said rear end to said front end of said support frame;

said cutting station being positioned at the front end of said support frame and comprising a stop gate and a sawing section, said stop gate being located between said sawing section and said rear end of said support frame, said sawing section comprising a housing mounted to said support frame and a chain saw having a cutting bar pivotally mounted at a drive end of the cutting bar, and a rotator mechanism operable to rotate said bar through a 360° rotation about said drive end during and after completion of a log-sawing operation, such that after said chain saw is rotated through a portion of said 360° rotation to saw through said log, said rotator mechanism continues to rotate said cutting bar through the remainder of said 360° rotation simultaneously with said conveyor moving a remaining portion of said log into said cutting station for a subsequent sawing operation, said housing surrounding at least a portion of said cutting bar and said housing having an opening to accommodate said log.

11. The sawing assembly according to claim 10 wherein said log lead-in support member is mounted to said rear end about hinges whereby said member is rotatable upwardly to rest on top of said log support frame.

12. The sawing assembly according to claim 10 wherein said conveyor further comprising discharge rams which push said log across said upper surface of said conveyor.

13. The sawing assembly according to claim 10 wherein said support frame further comprising a feed roll positioned above said conveyor to engage a top surface of said log as said log is moved by said conveyor, said feed roll being spring biased against said log.

14. The sawing assembly according to claim 10 further comprising a debris discharge conveyor positioned between and below said conveyor and said stop gate to catch dirt, bark and other debris that is dislodged from said log as said log moves along said conveyor.

15. The sawing assembly according to claim 10 further comprising a log collector which includes a frame having a deck which catches said log after it is cut to said predetermined length and allows said log to pass down an incline to a collection rack.

16. The sawing assembly according to claim 10 wherein said conveyor is a chain belt conveyor having projections on its outer surface.

17. An assembly for sawing logs to a predetermined length comprising:

a log support frame including a front end and a rear end and opposite sides, said support frame further comprising a conveyor and a feed roll positioned above said conveyor to engage a top surface of a log as the log is moved by the conveyor, said feed roll being spring biased against the log;

a log lead-in support member positioned at the rear end of said support frame to support said log as said log passes through the support frame to be cut to said predetermined lengths, said log lead-in support member is mounted to said rear end of said support frame about hinges whereby said log lead-in support member is rotatable upwardly to rest on top of said support frame;

said conveyor supported on said support frame for moving said log lengthwise from the rear end to the front end of said support frame to a cutting station, said conveyor being upwardly inclined from said rear end to said front end of said support frame, said conveyor being a chain belt conveyor having projections on its outer surface;

said cutting station being positioned at the front end of said support frame and comprising a stop gate and a sawing section, said stop gate being located between said sawing section and said rear end of said support frame, said sawing section comprising a housing mounted to said support frame and a chain saw having a cutting bar pivotally mounted at a drive end, of the cutting bar and a rotator mechanism operable to rotate said bar through a 360° rotation about said drive end during and after completion of a log-sawing operation, such that after said chain saw is rotated through a portion of said 360° rotation to saw through said log, said rotator mechanism continues to rotate said cutting bar through the remainder of said 360° rotation simultaneously with said conveyor moving a remaining portion of said log into said cutting station for a subsequent sawing operation, said housing surrounding at least a portion of said cutting bar and said housing having an opening to accommodate said log;

a debris discharge conveyor positioned between and below the conveyor belt and said stop gate to catch dirt, bark and other debris that is dislodged from said log as said log moves along said conveyor; and a log collector which includes a frame having a deck which catches said log after said log is cut to said predetermined length and allows said log to pass down a collection rack.

* * * * *

UNITED STATES PATENT AND TRADEMARK OFFICE
CERTIFICATE OF CORRECTION

PATENT NO. : 5,884,545

DATED : March 23, 1999

INVENTOR(S) : Hamby, Jr.

It is certified that error appears in the above-identified patent and that said Letters Patent is hereby corrected as shown below:

On the title page, item [56],

In the References Cited, U.S. PATENT DOCUMENTS, line 3, "2,775,570" should read --2,755,570--; line 5, "O'quinn" should read --O'Quinn--; line 7, "Reifenhauser et al." should read --Reifenhäuser et al.--.

Column 7, line 29, after "up" insert --a--; line 33, "passes on" should read --is moved by--; line 38, after "below" insert --said--.

Signed and Sealed this

Seventeenth Day of August, 1999

*Attest:*

Q. TODD DICKINSON

*Attesting Officer*

*Acting Commissioner of Patents and Trademarks*